US009064659B2

(12) United States Patent
Lavado et al.

(10) Patent No.: US 9,064,659 B2
(45) Date of Patent: Jun. 23, 2015

(54) CIRCUIT INTERRUPTION DEVICE WITH CONSTRICTIVE ARC EXTINGUISHING FEATURE

(71) Applicants: Michael Lavado, Griswold, CT (US); Eric Morrison, Warwick, RI (US); William Bentley, North Dartmouth, MA (US); Peter Berg, North Attleboro, MA (US); Keith Kawate, Attleboro Falls, MA (US); Thomas Gasper, North Attleboro, MA (US); Keith Singer, Attleboro, MA (US); Keith Washburn, Natick, MA (US); Joseph L. Medeiros, Rehoboth, MA (US); Chistian Pellon, Norton, MA (US)

(72) Inventors: Michael Lavado, Griswold, CT (US); Eric Morrison, Warwick, RI (US); William Bentley, North Dartmouth, MA (US); Peter Berg, North Attleboro, MA (US); Keith Kawate, Attleboro Falls, MA (US); Thomas Gasper, North Attleboro, MA (US); Keith Singer, Attleboro, MA (US); Keith Washburn, Natick, MA (US); Joseph L. Medeiros, Rehoboth, MA (US); Chistian Pellon, Norton, MA (US)

(73) Assignee: Sensata Technologies Massachusetts, Inc., Attleboro, MA (US)

( * ) Notice: Subject to any disclaimer, the term of this patent is extended or adjusted under 35 U.S.C. 154(b) by 169 days.

(21) Appl. No.: 13/795,091

(22) Filed: Mar. 12, 2013

(65) Prior Publication Data

US 2014/0263189 A1 Sep. 18, 2014

(51) Int. Cl.

| | |
|---|---|
| ***H01H 33/04*** | (2006.01) |
| ***H01H 9/32*** | (2006.01) |
| *H01H 1/42* | (2006.01) |
| *H01H 71/02* | (2006.01) |

(52) U.S. Cl.

CPC ..... *H01H 33/04* (2013.01); *H01H 1/42* (2013.01); *H01H 9/32* (2013.01); *H01H 71/02* (2013.01)

(58) Field of Classification Search

CPC ..... H01H 33/901; H01H 2033/908; H01H 33/7023; H01H 33/91; H01H 2033/906; H01H 33/24; H01H 33/98; H01H 9/302; H01H 9/342

USPC ..... 439/16–23, 57

See application file for complete search history.

(56) References Cited

U.S. PATENT DOCUMENTS

| | | | | |
|---|---|---|---|---|
| 4,339,641 | A * | 7/1982 | Noeske | 218/64 |
| 5,313,180 | A * | 5/1994 | Vial et al. | 335/16 |
| 5,828,026 | A * | 10/1998 | Bruhl et al. | 218/150 |
| 5,902,978 | A * | 5/1999 | Zehnder et al. | 218/57 |
| 7,459,652 | B2 * | 12/2008 | Rival | 218/149 |
| 8,519,292 | B2 * | 8/2013 | Domejean | 218/23 |
| 2009/0120908 | A1 * | 5/2009 | Domejean | 218/23 |

FOREIGN PATENT DOCUMENTS

| | | |
|---|---|---|
| DE | 92 17 024 U1 | 2/1993 |
| DE | 10 2011 118713 A1 | 9/2012 |
| JP | 2002 075136 | 3/2002 |
| JP | 2007 280 726 | 10/2007 |

OTHER PUBLICATIONS

International Search Report, Application No. EP 14 15 8438, dated Jul. 8, 2014.

* cited by examiner

*Primary Examiner* — Truc Nguyen

(74) *Attorney, Agent, or Firm* — Chapin IP Law, LLC

(57) ABSTRACT

A circuit interruption device includes at least one constriction zone. The constriction zone provides for interference with arcing of an electrical signal. The device may include at least one expansion zone. The device may include at least one movable component to assist in creation of the at least one constriction zone. A method of fabrication is provided.

9 Claims, 3 Drawing Sheets

CIRCUIT INTERRUPTION DEVICE WITH CONSTRICTIVE ARC EXTINGUISHING FEATURE

BACKGROUND OF THE INVENTION

1. Field of the Invention

The invention disclosed herein relates to a circuit interruption device that includes at least one constrictive zone that provides for voltage reduction and extinguishing of an electric arc.

2. Description of the Related Art

A variety of circuit interruption devices have been devised to provide for protection of electrical circuits from electrical overload. A common type of protection device is known as a "circuit breaker." Generally, a circuit breaker includes a resettable mechanical contact break system.

All circuit interruption devices with mechanical contact break systems experience some level of "arcing" during circuit interruption (above a minimum circuit current and voltage). As discussed herein, and as a convention, "arcing" is with reference to an electric signal jumping from one contact to another contact through an air gap. Generally, the greater the current and/or voltage, the greater the probability or magnitude of arcing will be. Arcing can be problematic, particularly for circuit breakers that carry a large load (i.e., are designed to conduct a comparatively high current and/or voltage). Accordingly, circuit breakers are typically larger than desired in order to account for arcing. The excess size results in a more expensive circuit breaker than desired, and additionally results in oversized circuit protection systems.

Thus, what are needed are methods and apparatus to provide for reductions in circuit arcing in a mechanical contact break system such as a circuit breaker. Preferably, the methods and apparatus result in decreased size and cost of the break system.

SUMMARY OF THE INVENTION

In one embodiment, a circuit interruption device is provided. The device includes: at least one line side electrical contact and at least one respective load side electrical contact, the electrical contacts disposed within a case; each of the line side contacts configured for engagement with a respective load side contact, the engagement for electrically connecting an electrical supply with an electrical load; wherein the engagement includes at least one of the line side electrical contact and the respective load side electrical contact moving through an arcing zone to make an electrical connection; and, wherein the arcing zone includes at least one constriction zone adapted for limiting arcing between the respective electrical contacts.

In another embodiment, a method for fabricating a circuit interruption device is provided. The method includes: selecting at least one line side contact configured for engagement with a respective load side contact, the engagement for electrically connecting an electrical supply with an electrical load; and, disposing the at least one line side electrical contact and at least one respective load side electrical contact within a case; wherein the engagement includes at least one of the line side electrical contact and the respective load side electrical contact moving through an arcing zone to make an electrical connection; wherein the arcing zone includes at least one constriction zone adapted for limiting arcing between the respective electrical contacts.

In a further embodiment, a circuit interruption device is provided. The device includes at least one line side electrical contact and at least one respective load side electrical contact, the electrical contacts disposed within a case; each of the line side contacts configured for engagement with a respective load side contact, the engagement for electrically connecting an electrical supply with an electrical load; wherein the engagement includes at least one of the line side electrical contact and the respective load side electrical contact moving through an arcing zone to make an electrical connection; wherein the arcing zone includes an expansion zone proximate to a constriction zone, the constriction zone adapted for limiting arcing between the respective electrical contacts.

BRIEF DESCRIPTION OF THE DRAWINGS

The features and advantages of the invention are apparent from the following description taken in conjunction with the accompanying drawings in which.

DETAILED DESCRIPTION OF THE INVENTION

Disclosed herein is circuit interruption device with the constrictive arc extinguishing feature. The arc extinguishing feature provides for constriction of electric arcs that are generated during actuation of the circuit interruption device. Advantageously, the circuit interruption device disclosed herein provides for reductions in size and cost of manufacture. This results in savings to manufacturers and users and further provides for more versatile use of circuit interruption devices in general.

Figure 1:
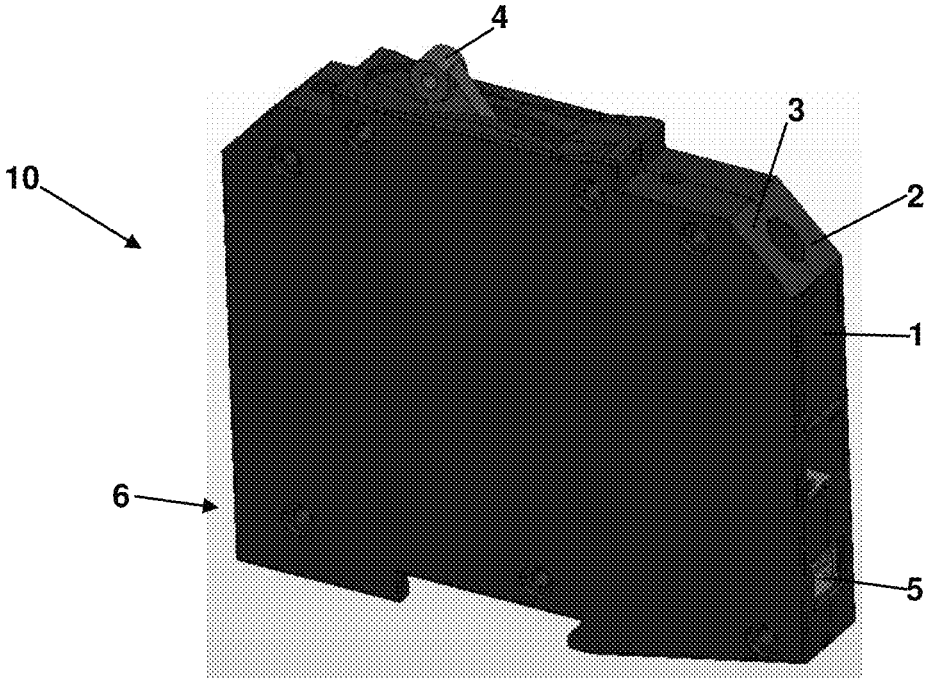
FIG. 1 is an isometric view of a circuit interruption device according to the teachings herein.

Referring now to FIG. 1, there is shown an exemplary circuit interruption device 10. In this example, the circuit interruption device 10 may also be referred to as a "circuit breaker." Although the teachings herein are introduced in the context of a circuit breaker, they may be applied in any circuit interruption device 10 where the techniques are deemed appropriate by a manufacturer, user, designer or other similarly interested party. That is, it should be noted that the circuit interruption device 10 is not limited to embodiments as disclosed herein, and may be used effectively in a variety of circuit interruption devices 10 as deemed appropriate.

In the exemplary embodiment, the circuit interruption device 10 is contained within a case 1. The case 1 includes two components namely a first side 2, and a second side 3. Each of the first side 2 and the second side 3 are shown to contain a respective side of the case 1. Of course, the circuit interruption device 10 may be of any shape deemed appropriate, and therefore the case 1 may include a plurality of components as deemed appropriate. For example, instead of the first side 2 and the second side 3, the case 1 may include a top and the bottom; a bottom and a multi-part top, and any other similar construction as deemed appropriate.

Generally, the case 1 is constructed of any material deemed appropriate for the construction of a circuit interruption device 10. Exemplary materials include hard plastics such as acrylonitrile butadiene styrene (ABS) and other materials such as fiberglass. Generally the case 1 is formed of materials that have a high dielectric constant, $\epsilon_r$, over the range of temperatures and operating conditions that may be experienced by the circuit interruption device 10.

The exemplary circuit interruption device 10 includes a handle 4. The handle 4 is provided for manual resetting and actuation of the circuit interruption device 10. The circuit interruption device 10 includes a line side connector 6 and a load side connector 5.

Figure 2:
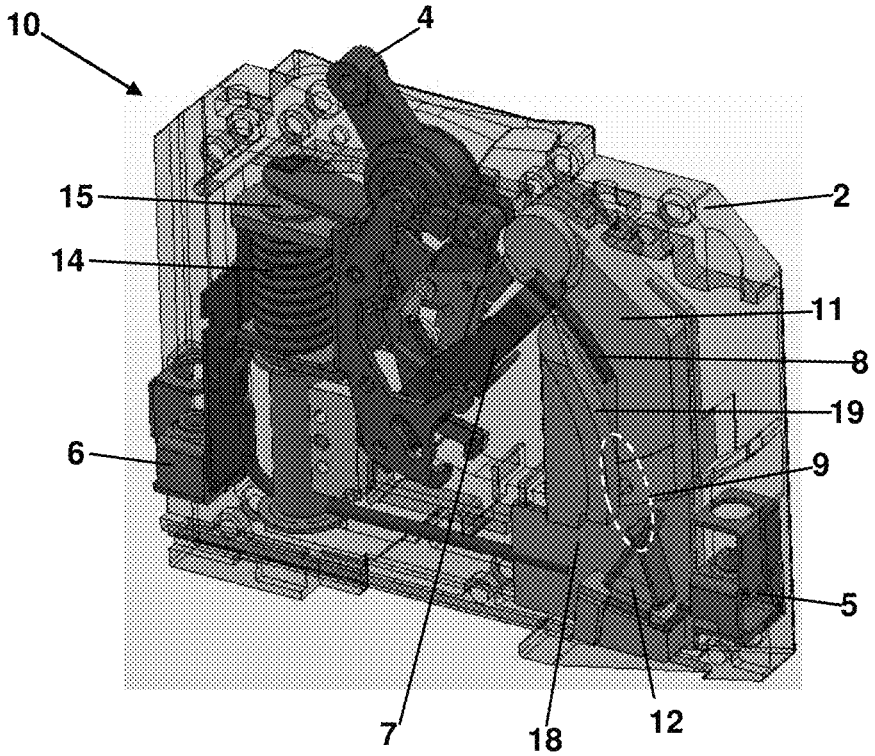
FIG. 2 is a cutaway isometric view of the circuit interruption device of FIG. 1.

Referring to FIG. 2, an isometric cutaway illustration of the circuit interruption device 10 of FIG. 1 is provided. Current entering the circuit interruption device 10 enters through the line side connector 6 into magnetic coil 14 through and down to contact bar 7. When the circuit interruption device 10 is configured to conduct the current, a movable contact 8 is engaged with a stationary contact 12. The stationary contact 12 conducts the current to the load side connector 5. When a load on the circuit interruption device 10 increases above a predetermined rating, a magnetic field generated by the magnetic coil 14 will cause the latch 15 to disengage, thus causing the circuit interruption device 10 to "un-latch" or "trip."

Also shown in the embodiment of FIG. 2, is a gate 11. In this example the gate 11 is movable. That is, the gate 11 may rotate about pivot point 20. Rotation of the gate 11 is generally constrained by other features within the case 1. For example, rotation of the gate 11 may be constrained by surface mounted features that are mounted on an interior surface of at least one of the first side 2 and the second side 3.

Generally, the gate 11 is formed of materials that have a high dielectric constant, $\epsilon_r$, over the range of temperatures and operating conditions that may be experienced by the circuit interruption device 10.

In this exemplary embodiment, the circuit interruption device 10 includes an arcing zone 9. The arcing zone 9 generally represents a volume where arcing between the movable contact 8 and the stationary contact 12 may occur during a tripping event. The volume of the arcing zone 9 is dependent upon a variety of factors. For example, as voltage or current traveling through the circuit interruption device 10 is increased, the arcing zone will likewise increase.

Note that the terminology "movable contact" and "stationary contact" are not limiting of the teachings herein. More specifically, as discussed herein, the movable contact 8 is with reference to a line side (i.e., a power supply) of the circuit interruption device 10. As discussed herein, the stationary contact 12 is with reference to a load side (i.e., a connection with a power consuming device) of the circuit interruption device 10. Accordingly, it should be considered that the terminology "movable contact" and "stationary contact" may be described by other similarly useful terminology such as with reference to electrical properties.

Figure 3:
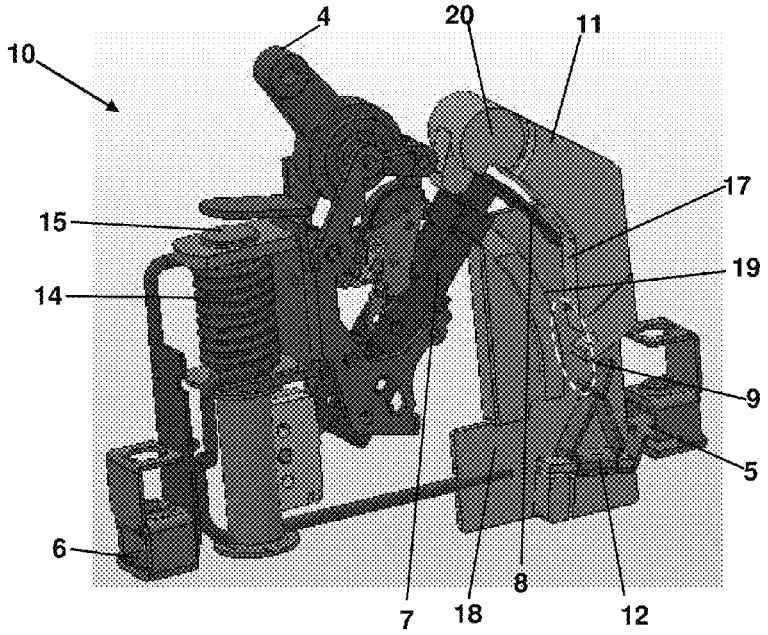
FIG. 3 is a cutaway isometric view of the circuit interruption device of FIG. 1 and FIG. 2.

Consider now also FIG. 3, where another cutaway illustration of the circuit interruption device 10 of FIGS. 1 and 2 is shown. In this example, the case 1 including the first side 2 and the second side 3 has been omitted from view. This omission is merely to enhance illustration and discussion of aspects of the circuit interruption device 10. As may be seen from this angle the gate 11 includes a movable inner surface 17. The movable inner surface 17 is configured to closely track or cooperate with the movable contact 8 as it is moved in relation to the stationary contact 12. In this embodiment, an internal center case 18 is also provided. The center case 18 may present a stationary inner surface 19. In this embodiment, the center case 18 also provides an insulative divider between a first movable contact 8 and a second movable contact 8, such as in a double knife break circuit interruption device 10.

In the embodiment shown in FIGS. 2 and 3, (referred to as "active" constriction), the gate 11 is configured to rotate about the pivot point 20 as the movable contact 8 rotates in relation to the stationary contact 20. The geometry of the gate 11 is such that rotation causes the movable inner surface 17 to rotate towards the stationary inner surface 19. As the movable inner surface 17 rotates towards the stationary inner surface 19, an arc constriction zone is created within the arcing zone 9. By constricting a portion of the arcing zone 9, reductions in arcing are realized. That is, this provides for an increase in voltage capability without increase in package size of the circuit interruption device 10. Alternatively, this design provides for smaller packaging of the circuit interruption device 10.

Generally, the arcing zone 9 includes both an arc constriction zone (as introduced above), and a zone of relatively little constriction. Generally the zones of relatively little constriction reduce the likelihood that small conductive deposits (carbon, copper, and other conductive materials) formed during arcing will result in longer arcing gaps during arcing. Similarly, zones of relatively little constriction (also referred to as "un-constricted zones" or "expansion zones") also allows the arc to expand and therefore allows the constriction zone to block out a larger percentage of the arc field, potentially reducing the arc extinguishing voltage.

Although one embodiment of the gate 11 is illustrated herein, this embodiment is merely illustrative and is not limiting of the teachings herein. For example, the gate 11 may include a plurality of moving components, cooperation of which result in the creation of the constriction zone. In general, the gate 11 may have a relatively constrained path that cooperates with the movable contact 8. For example, the gate 11 may be configured in a push-pull arrangement, instead of about the pivot point 20. (Embodiment not shown). Accordingly, it may be considered that the gate 11 moves in a "constrained path" of any type deemed appropriate in order to provide suitable constriction and expansion zones.

Figure 4A:
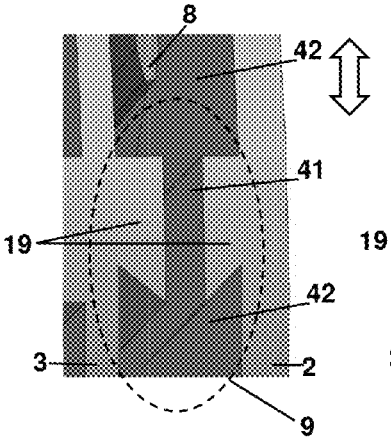
FIGS. 4A through 4C, collectively referred to herein as FIG. 4, depict embodiments of a constrictive arc extinguishing feature; and, FIG. 5A through 5B, collectively referred to herein as FIG. 5, are comparative illustrations depicting charge in a prior art device (FIG. 5A) and charge a circuit interruption device provided according to the teachings herein (FIG. 5B).
Figure 4B:
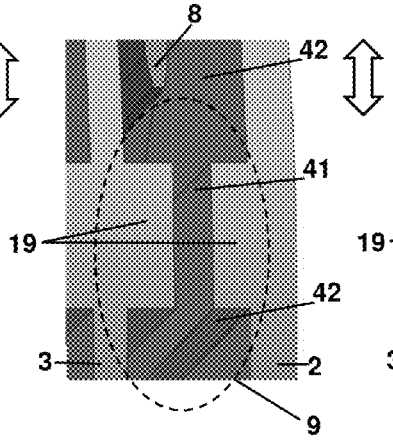
Figure 4C:
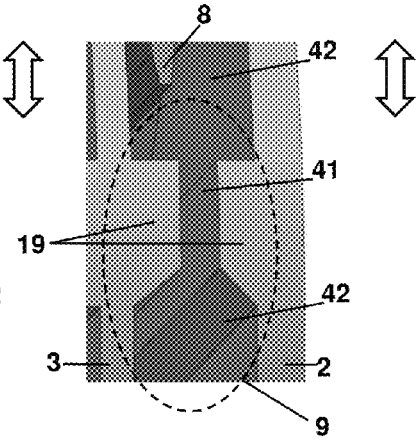

Referring now to FIG. 4, there are shown three exemplary embodiments of "inactive" constriction. In each of FIGS. 4A, 4B and 4C, a segment of the first side 2 and the second side 3 are depicted. In each of these embodiments, the first side 2 and the second side 3 include symmetrically disposed and configured constriction features 19. Together, the stationary inner surfaces 19 cooperate to form a constriction zone 41. Complementing each constriction zone 41 is at least one expansion zone 42. The movable contact 8 is configured to travel through each expansion zone 42 and constriction zone 41 before engaging the stationary contact 12 (not shown in FIG. 4). As shown in FIG. 4A, a cross-section of each of the first side 2 and the second side 3 shows that the constriction features 19 may be represented as in oblique right trapezoid, with a long side of the trapezoid facing the constriction zone 41. In FIG. 4B, a cross-section of the constriction features 19 shows that each of the constriction features 19 may be represented by a rectangle. In FIG. 4C, a cross-section of each of the first side 2 and the second side 3 shows that the constriction features 19 may be represented as in oblique right trapezoid, with a short side of the trapezoid facing the constriction zone 41. Generally, the embodiment of FIG. 4A provides better arc suppression and arc extinguishing as this arrangement interferes comparatively more with the electrical flux than the embodiments of FIG. 4B, and FIG. 4C. Of course, a cross-section of each of the constriction features 19 may be any one of a variety of geometric shapes. For example, a given constriction featured 19 may have a cross-section that is one of triangular, square, rectangular, irregular, patterned and the like. For example, in one embodiment, at least one of the constriction features may present a cross-section of a breaking wave.

Note that it is not a requirement that each of the stationary constriction features 19 are symmetric with respect to each other. Further, note that it is not necessary that the first side 2 and the second side 3 are used to provide the stationary constriction features 19. For example, at least a portion of the stationary constriction features 19 may be provided by the center case 18.

Figure 5A:
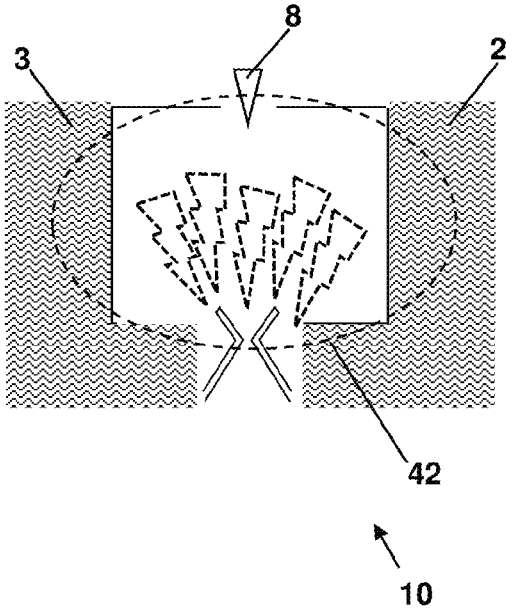
Figure 5B:
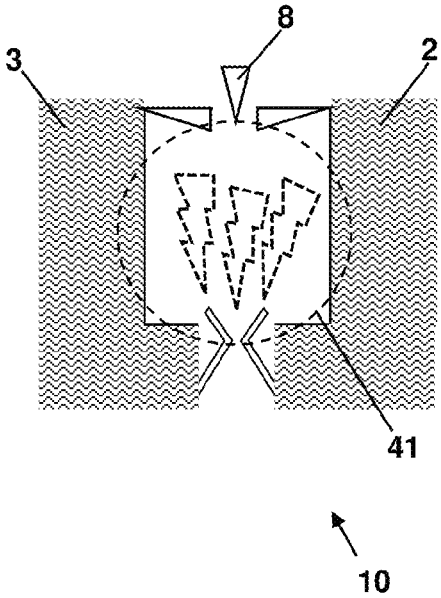

Referring now to FIG. 5, there are shown two illustrations of electrical flux within the circuit interruption device 10. In FIG. 5A, the expansion zone 42 essentially has room within the device for greater electrical flux (as arbitrarily depicted by lightning bolts). In contrast, as shown in FIG. 5B, the constriction zone 41 has a reduced volume and therefore limits the electrical flux that may be transmitted (as depicted by fewer of the lightning bolts).

A variety of combinations of constriction zones 41 and expansion zones 42 may be had. Generally, the constriction zone 41 will follow the expansion zone 42 when considered in relation to a path of a closing contact bar 7. However, a plurality of constriction zones 41 and expansion zones 42 may be used in any arrangement deemed appropriate. For example, multiple tightly spaced expansion zones 42 and constriction zones 41 may be incorporated into the circuit interruption device 10. This embodiment may be referred to as including "arc grooves" due to the appearance of the tightly spaced zones.

In some embodiments, at least one expansion zone 42 may include a vent to the outer environment (not shown).

Having thus introduced and described various aspects of the circuit interruption device. 10, some additional embodiments and other aspects are now discussed.

In general, it has been determined that the geometry of the entrance to the arcing zone 9 will influence the arc field. Generally, the arc field will be directed towards a lower pressure area of relatively little constriction, such as a vent. Additionally, a sharper or more acute entrance to the constriction zone 41 will discourage arc field organization and thus block out a larger percentage of the arc field, potentially reducing the arc extinguishing voltage.

Advantageously, this technology may be used in a variety of settings with a variety of devices. For example, use of arc constriction may be employed with higher break point devices (triple, quadruple, etc.), as well as a single break device. This may also be used with other circuit breaking devices such as, without limitation: switches, contactors, relays, disconnects, thermal circuit breakers, thermal-magnetic circuit breakers, toggle, push-pull buttons, push-push, automatic reset, and other similar devices. Arc constriction may also be used with AC or DC switching devices, including other (higher or lower) voltage rated circuits; a contact system that omits either the first un-constricted (i.e., expansion) zone or the second; a contact system that has more active constriction zone (e.g. biased flap, or compressed tube, that more completely constricts the arc).

Further, designs of the circuit interruption device that includes the constriction zone may consider and/or beneficially use arc constriction geometries to amplify the effects of the constriction (more acute arc constriction zone entrance); arc constriction geometries in combination with ablative materials; arc constriction geometries on devices other than knife contacts (button contacts, wiping contacts, etc.); arc constriction geometries on devices other than movable and stationary contact systems (e.g. where both contacts move away from a constriction zone).

Further, other aspects of the circuit interruption device may be configured with regards for the use of a constriction zone. For example, geometry of the constriction zone may be designed with consideration of the velocity at which the movable contact enters the constriction zone. Modifications to the knife contact system such as pinch force on the knife contact may be used. Further, arc constriction geometries may be used in devices with virtually any mechanism design (e.g. a more purely tease free contact closing designs).

Arc constriction geometries may be incorporated into devices with other arc mitigation element (arc grids, anti-arc tacking case features, arc shadows, arc horns, arc extenders, arc shields, insulation, etc.); arc constriction geometries may also be used in devices with arc grids (conductive, metal, etc.) in the constriction zone.

It should be recognized that the teachings herein are merely illustrative and are not limiting of the invention. Further, one skilled in the art will recognize that additional components, configurations, arrangements and the like may be realized while remaining within the scope of this invention. For example, configurations of sensors, circuitry and the like may be varied from embodiments disclosed herein. Generally, design and/or application of components of the redundant sensor is limited only by the needs of a system designer, manufacturer, operator and/or user and demands presented in any particular situation.

Various other components may be included and called upon for providing for aspects of the teachings herein. For example, additional materials, combinations of materials and/or omission of materials may be used to provide for added embodiments that are within the scope of the teachings herein.

When introducing elements of the present invention or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

In the present application a variety of variables are described, including but not limited to components, conditions, and performance characteristics. It is to be understood that any combination of any of these variables can define an embodiment of the invention. For example, a combination of a particular material for the body, with a set of sensors, under a particular range of a given environmental condition, but the specific combination might not be expressly stated, is an embodiment of the invention. Other combinations of articles, components, conditions, and/or methods can also be specifically selected from among variables listed herein to define other embodiments, as would be apparent to those of ordinary skill in the art.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit interruption device comprising:

at least one line side electrical contact and at least one respective load side electrical contact, the electrical contacts disposed within a case;

each of the line side contacts configured for engagement with a respective load side contact, the engagement for electrically connecting an electrical supply with an electrical load;

wherein the engagement comprises at least one of the line side electrical contact and the respective load side electrical contact moving through an arcing zone to make an electrical connection;

wherein the arcing zone comprises at least one constriction zone adapted for limiting arcing between the respective electrical contacts; and at least one movable component configured to create the at least one constriction zone in cooperation with the movement of the electrical contact, the at least one movable component selected from the group consisting of a gate configured to rotate about a pivot point and a gate configured to move in a constrained path relative to the movable contact member.

2. The device as in claim 1, wherein at least one electrical contact comprises one of a knife contact, a button contact and a wiping contact.

3. The device as in claim 1, wherein the arcing zone comprises an expansion zone before the at least one constriction zone.

4. The device as in claim 1, wherein the constriction zone results from at least one constriction feature in the arcing zone.

5. The device as in claim 4, wherein a cross-section of the at least one constriction feature is one of triangular, square, rectangular, irregular and patterned.

6. The devices in claim 1, wherein the arcing zone comprises a plurality of constriction zones and expansion zones.

7. A method for fabricating a circuit interruption device, the method comprising:

selecting at least one line side contact configured for engagement with a respective load side contact, the engagement for electrically connecting an electrical supply with an electrical load; and, disposing the at least one line side electrical contact and at least one respective load side electrical contact within a case;

wherein the engagement comprises at least one of the line side electrical contact and the respective load side electrical contact moving through an arcing zone to make an electrical connection; wherein the arcing zone comprises at least one constriction zone adapted for limiting arcing between the respective electrical contacts; and disposing within the case at least one movable component, the at least one movable component selected from the group consisting of a gate configured to rotate about a pivot point and a gate configured to move in a constrained path relative to the movable contact member.

8. The method as in claim 7, wherein selecting one of the contacts comprises selecting one of a knife contact, a button contact and a wiping contact.

9. The method as in claim 7, wherein disposing within a case comprises assembling a first side and a second side about the circuit interruption device.

* * * * *